US010919320B2

(12) United States Patent
Ishihara et al.

(10) Patent No.: US 10,919,320 B2
(45) Date of Patent: Feb. 16, 2021

(54) LIGHT IRRADIATION DEVICE, IMAGE FORMING APPARATUS, COMPUTER READABLE MEDIUM STORING PROGRAM, AND LIGHT IRRADIATION METHOD

(71) Applicant: FUJI XEROX CO., LTD., Tokyo (JP)

(72) Inventors: Takuma Ishihara, Ebina (JP); Takeshi Zengo, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/505,800

(22) Filed: Jul. 9, 2019

(65) Prior Publication Data

US 2020/0269604 A1 Aug. 27, 2020

(30) Foreign Application Priority Data

Feb. 22, 2019 (JP) ..... JP2019-030844

(51) Int. Cl.
*B41J 11/00* (2006.01)
*G03G 15/04* (2006.01)

(52) U.S. Cl.
CPC ..... *B41J 11/002* (2013.01); *G03G 15/04036* (2013.01)

(58) Field of Classification Search
CPC ..... B41J 11/002; G03G 15/04036
See application file for complete search history.

(56) References Cited

U.S. PATENT DOCUMENTS 9,304,201 B2 * 4/2016 Ogata ..... G01S 17/04
2015/0158311 A1 6/2015 Ogasawara et al.

FOREIGN PATENT DOCUMENTS

JP 2015-112792 6/2015
WO 2016/019476 2/2016

OTHER PUBLICATIONS

English language abstract and machine translation of WO 2016/019476.

* cited by examiner

*Primary Examiner* — Sharon Polk
(74) *Attorney, Agent, or Firm* — Fildes & Outland, P.C.

(57) ABSTRACT

A light irradiation device includes: an irradiation portion that irradiates a member with light, the member having density varying in accordance with at least one of light or heat; and an adjustment portion that adjusts a light amount of the irradiation portion based on a change of the density in the member irradiated with the light by the irradiation portion.

22 Claims, 8 Drawing Sheets

· DENSITY CHANGE OF TONER

| LIGHT AMOUNT [J/cm²] | DENSITY (n3) | | |
|---|---|---|---|
| 0 | 2.101 | 2.103 | 2.103 |
| 1 | 2.266 | 2.264 | 2.266 |
| 2 | 2.415 | 2.418 | 2.391 |
| 3 | 2.548 | 2.53 | 2.519 |
| 4 | 2.64 | 2.649 | 2.631 |
| 5 | 2.74 | 2.751 | 2.736 |

· DENSITY CHANGE OF INK

| LIGHT AMOUNT [J/cm²] | DENSITY (n3) | | |
|---|---|---|---|
| 0 | 1.041 | 1.04 | 1.041 |
| 1 | 1.045 | 1.059 | 1.061 |
| 2 | 1.076 | 1.084 | 1.063 |
| 3 | 1.098 | 1.085 | 1.074 |
| 4 | 1.106 | 1.099 | 1.086 |
| 5 | 1.113 | 1.1 | 1.117 |

LIGHT IRRADIATION DEVICE, IMAGE FORMING APPARATUS, COMPUTER READABLE MEDIUM STORING PROGRAM, AND LIGHT IRRADIATION METHOD

CROSS-REFERENCE TO RELATED APPLICATIONS

This application is based on and claims priority under 35 USC 119 from Japanese Patent Application No. 2019-030844 filed on Feb. 22, 2019.

BACKGROUND

1. Technical Field

The present invention relates to a light irradiation device, an image forming apparatus, a computer readable medium storing a program, and a light irradiation method.

2. Related Art

For example, JP-A-2015-112792 describes a droplet drying device for adjusting density in an image formed on a recording medium. The droplet drying device has an irradiation unit and a control unit. Droplets ejected to a recording medium by an ejection unit for ejecting the droplets in accordance with an image are irradiated with infrared laser light by the irradiation unit. Based on attributes giving influence to the quality of the image, at least one of irradiation timing, an irradiation position or an irradiation amount of the droplets irradiated with the infrared laser light by the irradiation unit is controlled by the control unit.

SUMMARY

Assume that paper with a monochromatic image (so-called solid image) formed in ink within a fixed region is used for adjustment of the light amount of the light irradiation device. In this case, since the ink is liquid, density unevenness tends to occur when the ink is irradiated with laser light and dried. Therefore, when the light amount is adjusted using a density change of the ink which has been dried, it may be difficult to adjust the light amount accurately, due to influence of the density unevenness of the ink.

Aspects of non-limiting embodiments of the present disclosure relate to provide a light irradiation device, an image forming apparatus and a program, capable of adjusting a light amount accurately in comparison with a case where the light amount is adjusted using paper with a monochromatic image formed in ink within a fixed region.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a light irradiation device including: an irradiation portion that irradiates a member with light, the member having density varying in accordance with at least one of light or heat; and an adjustment portion that adjusts a light amount of the irradiation portion based on a change of the density in the member irradiated with the light by the irradiation portion.

BRIEF DESCRIPTION OF DRAWINGS

Exemplary embodiments of the present invention will be described in detail based on the following figures, wherein.

DETAILED DESCRIPTION

An example of a mode for carrying out the present invention will be described below in detail with reference to the drawings.

First Exemplary Embodiment

Figure 1:
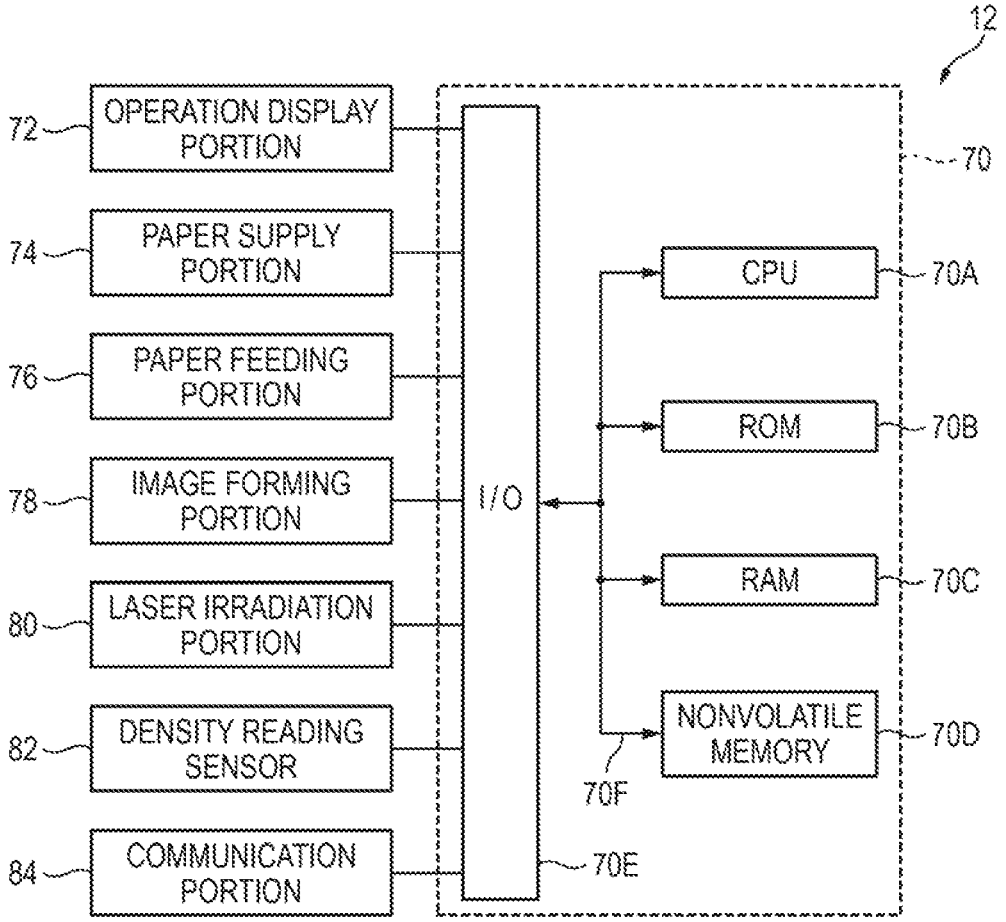
FIG. 1 is a block diagram illustrating an example of an electrical configuration of an image forming apparatus according to a first exemplary embodiment.

FIG. 1 is a block diagram illustrating an example of an electrical configuration of an image forming apparatus 12 according to a first exemplary embodiment.

As illustrated in FIG. 1, the image forming apparatus 12 has, for example, a control portion 70, an operation display portion 72, a paper supply portion 74, a paper feeding portion 76, an image forming portion 78, a laser irradiation portion 80, a density reading sensor 82, and a communication portion 84. In the image forming apparatus 12 according to the exemplary embodiment, an inkjet system is used as a method for forming an image.

In the exemplary embodiment, a light irradiation device is constituted by the control portion 70, the laser irradiation portion 80 and the density reading sensor 82. Incidentally, the density reading sensor 82 may be provided outside the image forming apparatus 12. In this case, the light irradiation device is constituted by the control portion 70 and the laser irradiation portion 80. In addition, the exemplary embodiment will be described in a case where the light irradiation device is applied to the image forming apparatus 12. However, an example to which the light irradiation device is applied is not limited to the image forming apparatus 12.

The control portion 70 has a configuration in which a CPU (Central Processing Unit) 70A, a ROM (Read Only Memory) 70B, a RAM (Random Access Memory) 70C, a nonvolatile memory 70D and an input/output interface (I/O)

70E are connected through a bus 70F. The operation display portion 72, the paper supply portion 74, the paper feeding portion 76, the image forming portion 78, the laser irradiation portion 80, the density reading sensor 82 and the communication portion 84 are connected to the 1/O 70E. In the control portion 70, for example, a program installed in the ROM 70B in advance is executed by the CPU 70A, and data communication with the portions 72 to 84 is performed mutually along the program to thereby control the portions 72 to 84. Thus, an image can be formed by the image forming apparatus 12.

The operation display portion 72 accepts an instruction from a user of the image forming apparatus 12, and informs the user of various kinds of information about the operating state, etc. of the image forming apparatus 12. The operation display portion 72 is, for example, configured to include a touch panel display for displaying buttons or various information to programmably implement the acceptance of operating instructions, hardware keys such as numeric keys and a start button, etc.

The paper supply portion 74 is, for example, configured to include a paper storing unit where paper is stored, and a supply mechanism for supplying the paper from the paper storing unit to the paper feeding portion 76 which will be described later. Incidentally, the paper is an example of a recording medium.

The paper feeding portion 76 feeds the paper supplied from the paper supply portion 74, to the image forming portion 78, the laser irradiation portion 80 and the density reading sensor 82 which will be described later. In addition, the paper feeding portion 76 discharges the paper on which an image has been formed by the image forming portion 78, to the outside of a housing of the image forming apparatus 12. The paper feeding portion 76 is, for example, configured to include a driving motor, a pair of rollers which are rotationally driven by the driving motor so as to feed the paper held in a gap between the rollers, etc.

The image forming portion 78 is an example of a forming portion. The image forming portion 78 ejects ink from an ejection position instructed by the control portion 70 and by an amount instructed by the control portion 70 to form an image on the paper in accordance with image information intended to form an image. The image forming portion 78 is, for example, configured to include an ink ejection member, at least one of a voltage source or a current source for supplying a voltage or a current to the ink ejection member, etc.

Incidentally, examples of the ink include water-based ink, solvent ink which is ink with a solvent to be evaporated, ultraviolet-curable ink, etc. In the exemplary embodiment below, it is assumed that water-based ink is used. Hereinafter "ink" or "ink droplet" described simply means "water-based ink" or "water-based ink droplet".

The laser irradiation portion 80 is an example of an irradiation portion. In the exemplary embodiment, the laser irradiation portion 80 functions as a laser drying device. The laser irradiation portion 80 irradiates an image formed on the paper by the image forming portion 78, for example, with infrared laser light to dry droplets on the paper and fix the image. In the exemplary embodiment below, "infrared laser light" will be described simply as "laser light".

As for the wavelength of the laser light, a waveform range of from about 800 nm or longer and about 12,000 nm or shorter is used. Particularly, a waveform range of from 800 nm to 1,200 nm is used.

The density reading sensor 82 is an example of a measuring portion. The density reading sensor 82 reads density in an image formed on the paper through the image forming portion 78 and the laser irradiation portion 80. Information of the read density in the image is sent to the control portion 70. The control portion 70 compares the information with image information of an image (original image) designated by a user. The image information includes classification of the image, density information of the image, ejection position information of droplets, etc. The control portion 70 corrects control on the image forming portion 78 and so on so that the density in the image formed on the paper is closer to the density designated by the density information included in the image information of the original image. Here the classification of the image is information indicating an element of the image, for example, as to whether the image indicated by the image information is a graphic such as a photograph, a drawing, a table or a graph, or a text such as a character or a sign.

The communication portion 84 is an interface which is connected to a wire or wireless communication line so as to make mutual data communication with a terminal device such as a personal computer (not shown) connected to the communication line. For example, the communication portion 84 accepts an image forming request and image information of an original image from the terminal device through the communication line.

Incidentally, provision of various programs engaging in image formation is not limited to the form in which they are installed in the ROM 70B in advance. The programs may be provided in a form in which they are stored in a computer-readable memory medium such as a CD-ROM or a memory card, a form in which they are distributed by wire or wireless through the communication portion 84, etc.

Figure 2:
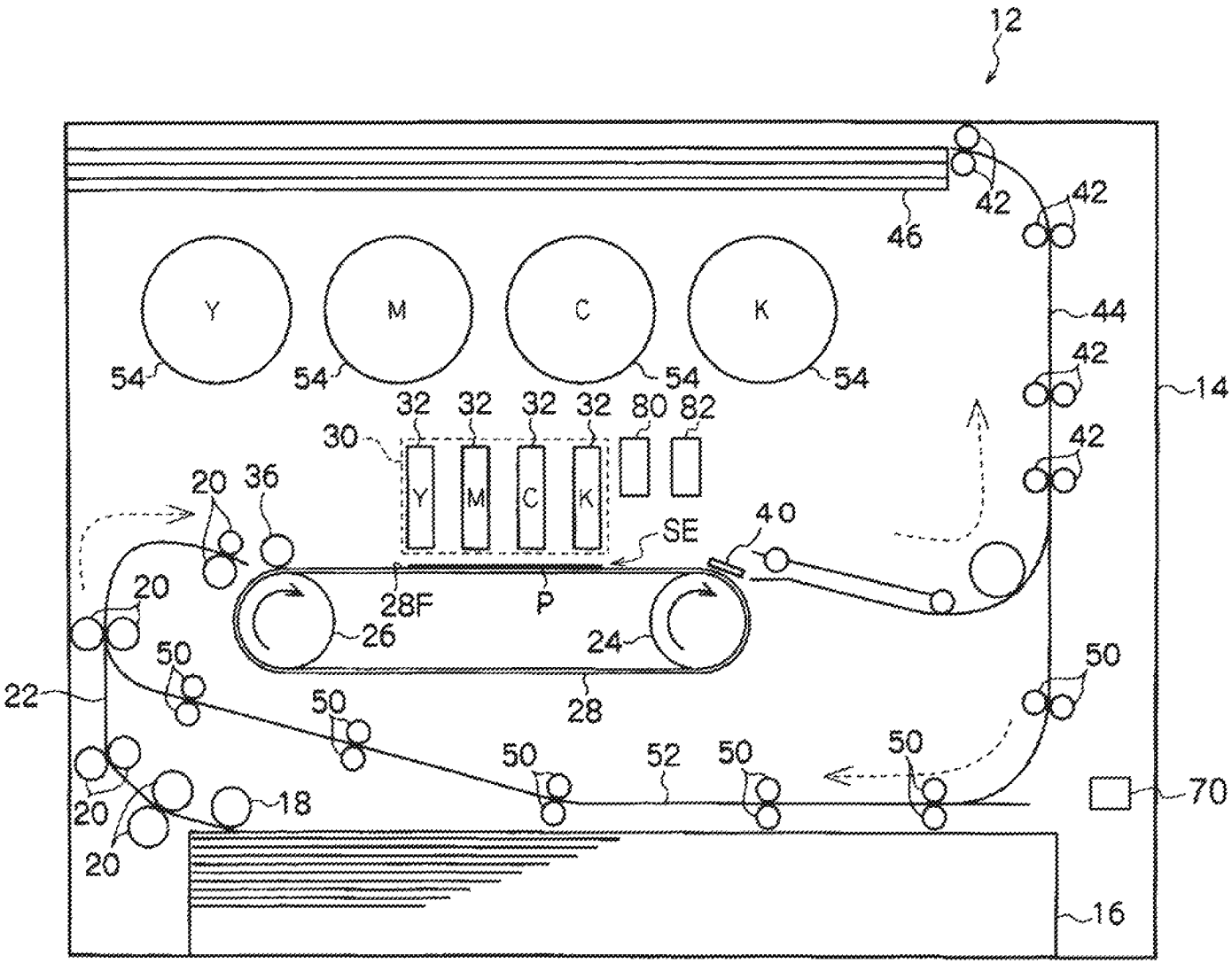
FIG. 2 is a side view illustrating a configuration example of the image forming apparatus according to the first exemplary embodiment.

FIG. 2 is a side view illustrating a configuration example of the image forming apparatus 12 according to the first exemplary embodiment.

A paper feed tray 16 is provided in a lower portion inside a housing 14 of the image forming apparatus 12. For example, a stack of A4-size cut sheets are stored as paper P. The paper P in the paper feed tray 16 is extracted sheet by sheet by a pickup roll 18. The extracted paper P is fed by a plurality of feed roller pairs 20 constituting a predetermined feed path 22. The simple phrase "feeding direction" in the following description means a feeding direction (sub-scanning direction) of the paper P which is a recording medium. The simple phrase "width direction" means a width direction (main scanning direction) of the paper P which is a recording medium. The words "upstream" and "downstream" mean the upstream and the downstream of the feeding direction respectively.

An endless feeding belt 28 stretched between a driving roll 24 and a driven roll 26 is disposed above the paper feed tray 16. The paper feeding portion 76 is constituted by the driving roll 24, the driven roll 26 and the feeding belt 28. A head array 30 is disposed above the feeding belt 28 so as to face a flat part 28F of the feeding belt 28. The facing region serves as an ejection region SE where ink droplets are ejected from the head array 30.

On the other hand, a charging roll 36 to which a power supply (not shown) is connected is disposed on the upstream side of the head array 30. The charging roll 36 is driven while holding the feeding belt 28 and the paper P between the charging roll 36 and the driven roll 26 so that the charging roll 36 can move between a pressing position where the charging roll 36 presses the paper P on the feeding belt 28 and a leaving position where the charging roll 36 leaves the feeding belt 28. In the pressing position, a predetermined difference in potential occurs between the charging roll 36 and the driven roll 26 which is grounded. Accordingly, when charges are imparted to the paper P, the paper P is electrostatically attracted on the feeding belt 28.

The paper P fed through the feed path 22 is held on the feeding belt 28 to reach the ejection region SE, where the paper P faces the head array 30. Ink droplets corresponding to the image information of the original image are ejected from the head array 30.

Incidentally, a unit for feeding the paper P is not limited to the feeding belt 28. For example, according to another configuration, the paper P may be attracted and held on the outer circumference of a feed roller formed into a cylindrical or columnar shape, and rotated. In addition, an example in which cut sheets are used as the paper P in the exemplary embodiment. However, according to another configuration, continuous paper which is long in the feeding direction may be fed to the ejection region SE by the feed roller pairs 20 and the driving roll 24, etc.

In the exemplary embodiment, the head array 30 is formed into a long shape in which an effective droplet ejection region is made equal to or longer than the width (length in a direction perpendicular to the feeding direction) of the paper P. Four ink heads 32 corresponding to four colors, that is, yellow (Y), magenta (M), cyan (C) and black (K) are disposed in the feeding direction in the head array 30 so as to record a full-color image. Incidentally, a method for ejecting ink droplets in each ink head 32 is not particularly limited, but a known method such as a so-called thermal system or a so-called piezoelectric system may be used.

Although only one head array 30 is shown in FIG. 1, a plurality of head arrays 30 may be disposed to face the feeding belt 28 if necessary.

On the downstream side of the head array 30 in the feeding direction, the layer irradiation portion 80 having a matrix shape or a long shape in which an effective laser irradiation region is made equal to or longer than the width of the paper P is disposed so that a laser radiating surface is opposed to the feeding belt 28.

The laser irradiation portion 80 irradiates ink droplets on the paper P fed by the feeding belt 28, with laser light to thereby dry the ink droplets and accelerate the fixation of the image onto the paper P. Although only one laser irradiation portion 80 is shown in FIG. 1, a plurality of laser irradiation portions 80 may be disposed to face the feeding belt 28 if necessary.

Further, on the downstream side of the laser irradiation portion 80 in the feeding direction, the density reading sensor 82 having a sheet-like shape or a long shape in which an effective density reading region is made equal to or longer than the width of the paper P is disposed so that a density reading surface is opposed to the feeding belt 28.

For example, the density reading sensor 82 radiates light from a light emitting element included inside the density reading sensor 82, onto an image formation surface of the paper P fed by the feeding belt 28, and receives reflected light thereof in a light receiving element included inside the density reading sensor 82. Thus, the density reading sensor 82 reads the density in the image from intensity of each spectral component included in the reflected light. An LED (Light Emitting Diode) or the like is used as an example of the light emitting element, and a CCD (Charge Coupled Device) or the like is used as an example of the light receiving element.

The density in the image read by the density reading sensor 82 is sent to the control portion 70, and used as a feedback control quantity for correcting the density in the image formed on the paper P in an image forming process performed thereafter. The density reading sensor 82 is not essential for the image forming apparatus 12. In the exemplary embodiment, the density reading sensor 82 is disposed in the image forming apparatus 12 by way of example. To read the density in the image on the paper P, the density reading sensor 82 may be replaced by a density reading camera.

On the downstream side of the density reading sensor 82, a peeling plate 40 is disposed so that the peeling plate 40 can enter the gap between the paper P and the feeding belt 28 to thereby peel the paper P from the feeding belt 28.

The peeled paper P is fed by a plurality of discharge rollers 42 constituting a discharge path 44 on the downstream side of the peeling plate 40. Thus, the paper P is discharged to a paper discharge tray 46 provided in an upper portion of the housing 14.

An inversion path 52 configured to include a plurality of inverting rollers 50 is provided between the paper feed tray 16 and the feeding belt 28. A mechanism for performing so-called duplex printing is provided in the inversion path 52. Due to the mechanism, the paper P having an image formed on one surface thereof is inverted and held on the feeding belt 28 again so that another image can be formed on the other surface of the paper P.

In addition, ink tanks 54 storing C, M, Y and K inks respectively are provided between the feeding belt 28 and the paper discharge tray 46. The inks of the ink tanks 54 are supplied to the head array 30 through ink supply piping (not shown).

A series of processings engaging in image formation described above are controlled by the control portion 70. Although only one paper feed tray 16 is shown in FIG. 2, a plurality of paper feed trays 16 may be provided so that different paper sizes or different paper types of paper P can be stored in the paper feed trays 16 respectively. In this case, in accordance with designation from a user, a pickup roll 18 for extracting the designated paper P is driven, and the designated paper P is fed to the feed path 22.

When a light amount of the laser irradiation portion 80 is adjusted by use of a density change of ink which has been dried up as described above, the light amount may be hardly adjusted accurately due to influence of density unevenness in the ink. A configuration in which the light amount of the laser irradiation portion 80 is adjusted according to the exemplary embodiment will be described below with reference to FIG. 3.

Figure 3:
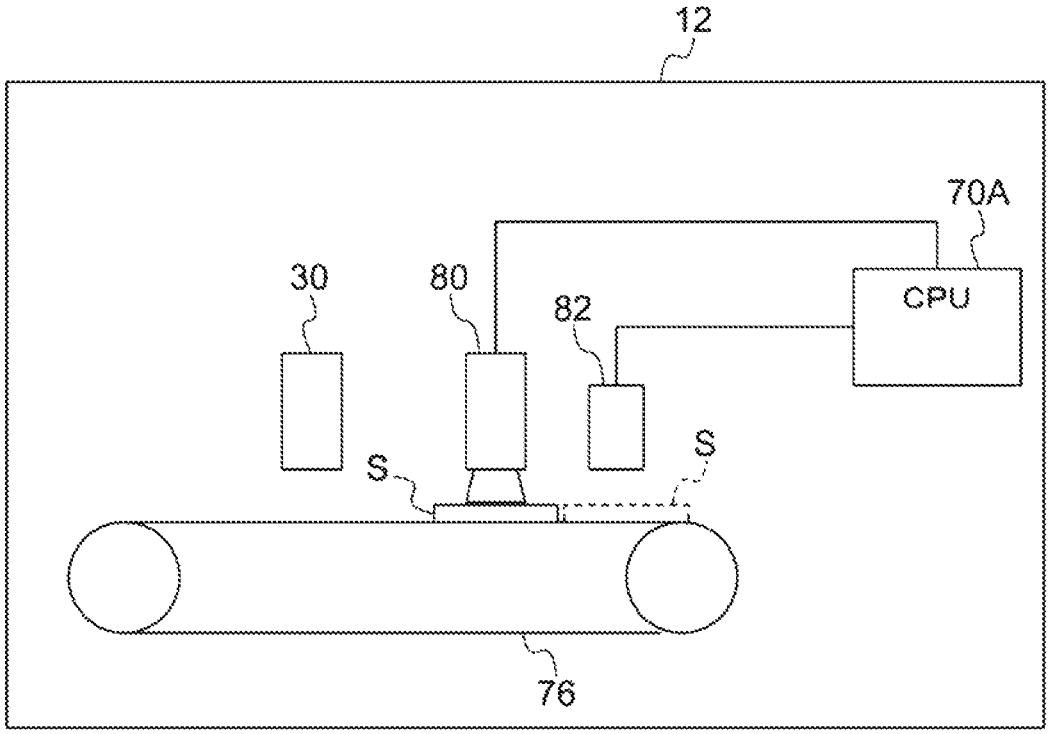
FIG. 3 is a side view schematically illustrating a main portion configuration of the image forming apparatus according to the first exemplary embodiment.

FIG. 3 is a side view schematically showing a main portion configuration of the image forming apparatus 12 according to the first exemplary embodiment.

In the image forming apparatus 12 shown in FIG. 3, a light amount measuring member S which has been cut into a predetermined size is disposed in a position facing the laser irradiation portion 80 of the paper feeding portion 76. In the exemplary embodiment, a member whose density is changed by at least one of light or heat is used as the light amount measuring member S, in place of the paper where a solid image is formed in ink. Specifically, a sheet-like member coated with at least one of a thermosensitive material, a photosensitive material or toner is used. A substance which can be discolored due to a chemical reaction by heat is used as the thermosensitive material. Specific examples of the substance include a solvent containing a leuco dye as a coloring matter precursor and a developer reacting with the leuco dye. On the other hand, a substance which can be discolored due to a chemical reaction by light is used as the photosensitive material. Specific examples of the substance include photosensitive diazonium salt, silver halide, etc.

Thermosensitive paper is, for example, used as the light amount measuring member S. The thermosensitive paper is evenly coated with a thermosensitive material. Accordingly, the thermal paper rarely causes density unevenness as ink. Thus, a density change is reflected directly on a change in light amount. Alternatively, photosensitive paper evenly coated with a photosensitive material may be used as the light amount measuring member S. In the same manner as the thermosensitive paper, the photosensitive paper rarely causes density unevenness as ink. Thus, a density change is reflected directly on a change in light amount. Accordingly, the photosensitive paper is suitable for adjusting the light amount accurately.

Alternatively, toner-coated paper which is evenly coated with toner may be used as the light amount measuring member S. Since the toner is composed of fine particles, the toner-coated paper rarely causes density unevenness as ink. Thus, in the same manner as in the thermosensitive paper and the photosensitive paper, a density change of the toner is reflected directly on a change in light amount. Accordingly, the toner-coated paper is suitable for adjusting the light amount accurately. Incidentally, black toner has higher light absorbability than any other color toner. The black toner is preferred because the black toner can support various light sources. Comparative examples showing that toner can improve the accuracy of light amount adjustment than ink will be explained below with reference to FIG. 4A to FIG. 4C.

Figures 4A, 4B, 4C:
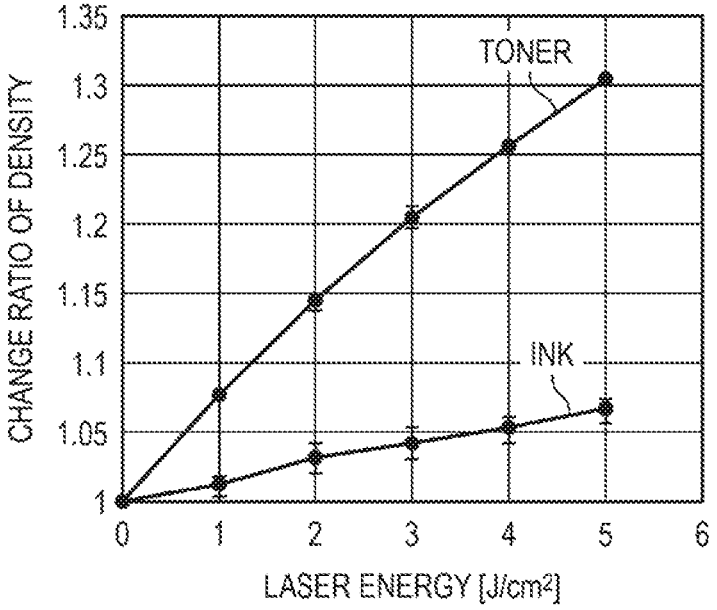
FIG. 4A is a table showing an example of a density change of toner.
FIG. 4B is a table of a density change of ink.
FIG. 4C is a graph showing an example of a density change ratio in each of the toner and the ink.

FIG. 4A is a table showing an example of a density change of toner. FIG. 4B is a table showing an example of a density change of ink. FIG. 4C is a graph showing an example of a density change ratio in each of the toner and the ink.

FIG. 4A shows density values of the toner irradiated with laser energy (light amount) in each of six stages of 0 to 5 [J/cm$^2$]. Three density values are measured in each stage. The three values in each stage are measured in different places respectively.

In the same manner as in FIG. 4A, FIG. 4B shows density values of the ink irradiated with laser energy (light amount) in each of six stages of 0 to 5 [J/cm$^2$]. Three density values are measured in each stage. The three values in each stage are measured in different places respectively.

In the graph shown in FIG. 4C, the ordinate designates a density change ratio, and the abscissa designates laser energy (light amount). Here, the value of density in each stage of the laser energy of 1 to 5 [J/cm$^2$] is shown as a ratio to the value of density in the laser energy of 0.

From measurement results shown in FIG. 4A to FIG. 4C, it is understood that the toner-coated paper has a large density change and a small density variation when irradiated with laser light, in comparison with the ink-coated paper. Accordingly, when the toner-coated paper is used, the accuracy of light amount adjustment is improved.

Return to FIG. 3. The laser irradiation portion 80 according to the exemplary embodiment irradiates the light amount measuring member S with laser light. The light amount measuring member S irradiated with the laser light by the laser irradiation portion 80 is manually or automatically set in a predetermined position facing the density reading sensor 82. Then the density of the light amount measuring member S is measured by the density reading sensor 82. Then the CPU 70A adjusts the light amount of the laser irradiation portion 80 based on a density change in the light amount measuring member S measured by the density reading sensor 82. The CPU 70A functions as an example of an adjustment portion by writing a light amount adjustment processing program stored in the ROM 70B into the RAM 70C, and executing the light amount adjustment processing program written in the RAM 70C.

Although the density in the light amount measuring member S is measured using the density reading sensor 82 built in the image forming apparatus 12 in the exemplary embodiment, the present invention is not limited thereto. For example, the density in the light amount measuring member S may be measured using the density reading sensor 82 provided outside the image forming apparatus 12. In this case, information of the density measured by use of the external density reading sensor 82 is configured to be inputted into the CPU 70A.

In addition, in FIG. 3, in order to suppress influence of external light or heat on the light amount measuring member S, it is desired to form a space including at least the laser irradiation portion 80 and the light amount measuring member S as a light-shielded space.

In addition, the light amount measuring member S is not limited to cut paper, but may be rolled paper. In addition, the light amount measuring member S may be replaced in accordance with the wavelength of the laser light. In this case, when a light amount measuring member S easy to respond is used in accordance with the wavelength of the laser light, the accuracy of the light amount adjustment is more improved.

Next, specific configurations of the laser irradiation portion 80 and the density reading sensor 82 will be described with reference to FIG. 5.

Figure 5:
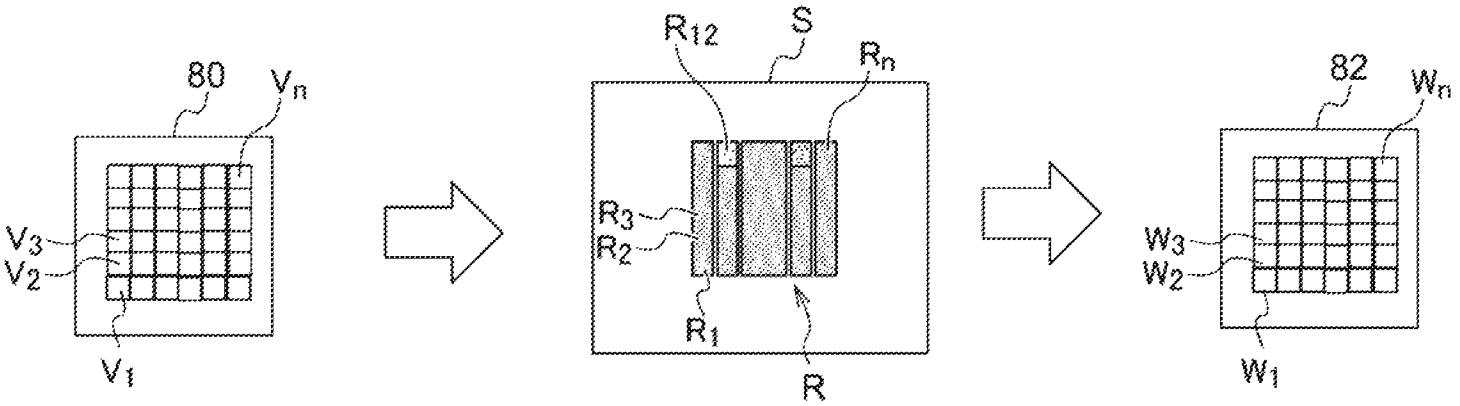
FIG. 5 is a view for explaining configurations of a laser irradiation portion and a density reading sensor according to the exemplary embodiment.

FIG. 5 is a view for explaining the configurations of the laser irradiation portion 80 and the density reading sensor 82 according to the exemplary embodiment.

For example, the laser irradiation portion 80 has a structure in which 1 laser light emitting elements from a laser light emitting element $V_1$ to a laser light emitting element $V_n$ are disposed in an m×m matrix so that a laser radiating surface faces the light amount measuring member S. Incidentally, among various laser light emitting elements, VCSEL (Vertical Cavity Surface Emitting Laser) elements are preferred because of their excellent properties such as comparatively low cost, low power consumption, easiness to be made two-dimensional and capability to be modulated at high speed. The g laser light emitting elements from the laser light emitting element $V_1$ to the laser light emitting element $V_n$ will be also referred to as laser light emitting elements V generically.

The laser irradiation amount of each laser light emitting element V in the laser irradiation portion 80 can be adjusted individually, for example, in accordance with a value of a current supplied to the laser light emitting element V. Specifically, as the value of the current supplied to the laser light emitting element V is increased, the laser irradiation amount radiated from the laser light emitting element V increases. In the description of the exemplary embodiment, a not-shown current source is controlled to change a value of a current supplied to each laser light emitting element V of the laser irradiation portion 80, so as to adjust the laser irradiation amount. However, for example, a not-shown voltage source may be controlled to change a value of a voltage supplied to each laser light emitting element V, so as to adjust the laser irradiation amount radiated from the laser light emitting element V.

For example, the density reading sensor 82 has a structure in which n density sensors from a density sensor $W_1$ to a density sensor $W_n$ are disposed in an m×m matrix so that a density reading surface faces the light amount measuring member S. The g density sensors from the density sensor $W_1$ to the density sensor $W_n$ will be also referred to as density sensors W generically. Each density sensor W is configured as a sensor including a light emitting element and a light receiving element.

An irradiation region R is formed in the light amount measuring member S by irradiation with laser light from the laser irradiation portion 80. In the irradiation region R, regions $R_1$ to $R_n$ are formed in accordance with the irradiation with the laser light from the laser light emitting elements $V_1$ to $V_n$ respectively. Densities in those regions $R_1$ to $R_n$ differ in accordance with laser irradiation amounts thereof. For example, the density in the region $R_{12}$ is thinner than the density in any other region, showing the laser irradiation amount in the region $R_{12}$ is smaller.

Each laser light emitting element V and each density sensor W are associated with each other in advance. Thus, the density in the region $R_1$ of the light amount measuring member S irradiated with laser light by the laser light emitting element $V_1$ is read by the density sensor $W_1$, and the density in the region $R_2$ of the light amount measuring member S irradiated with laser light by the laser light emitting element $V_2$ is read by the density sensor $W_2$. The same thing can be applied to the regions $R_3$ to $R_n$ of the light amount measuring member S.

That is, the density reading sensor 82 measures the density in the light amount measuring member S irradiated with laser light by the laser irradiation portion 80, for each of the regions corresponding to the laser light emitting elements V respectively. Specifically, light is radiated from the light emitting element of each density sensor W onto the light amount measuring member S, and reflected light from the light amount measuring member S is received by the light receiving element. From intensity of the received reflected light, the density in the light amount measuring member S is measured for each region.

Then the CPU 70A adjusts the light amount from each of the laser light emitting elements V is adjusted so that the density in each region of the light amount measuring member S as measured by the density reading sensor 82 coincides with intended density determined in advance.

Although the number of laser light emitting elements is the same (n pieces) as the number of density sensors in the exemplary embodiment, the present invention is not limited thereto. For example, the number of laser light emitting elements may be made different from the number of density sensors. In addition, although the laser light emitting elements V and the density sensors W are disposed in matrix shapes respectively, the present invention is not limited thereto. For example, according to another form, the laser light emitting elements V and the density sensors W may be disposed in linear shapes respectively.

In addition, although the laser light emitting elements V are used as an example of a light source in an irradiation portion in the exemplary embodiment, the present invention is not limited thereto. Any light source can be used as long as it has directivity. For example, light emitting diodes (LED) may be used.

Next, the operation of the image forming apparatus 12 according to the first embodiment will be described with reference to FIG. 6.

Figure 6:
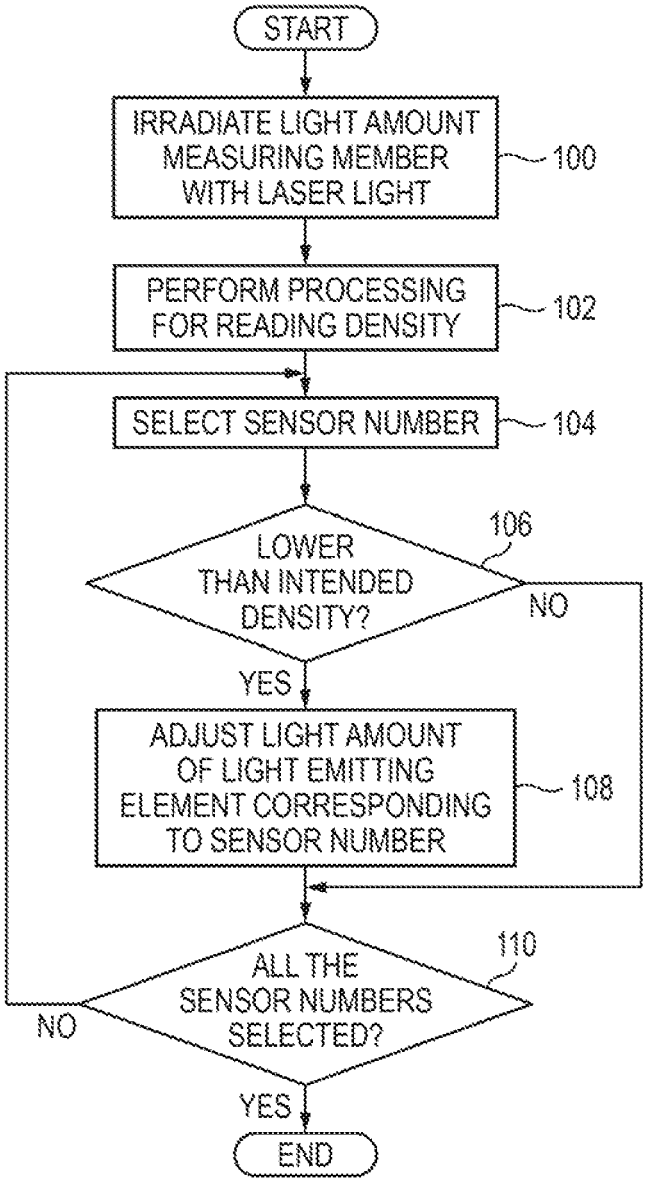
FIG. 6 is a flow chart showing an example of a flow of processing in a light amount adjusting processing program according to the first embodiment.

FIG. 6 is a flow chart showing an example of a flow of processing based on the light amount adjustment processing program according to the first exemplary embodiment.

First, when an instruction to start up the light amount adjustment processing program is given to the image forming apparatus 12, the following steps are executed. Incidentally, in the exemplary embodiment, the light amount measuring member S is set in advance in a position facing the laser radiating surface of the laser irradiation portion 80.

It is desired that the distance between the light amount measuring member S and the laser radiating surface of the laser irradiation portion 80 is adjusted to be substantially equal to the distance between the recording medium and the laser radiating surface of the laser irradiation portion 80.

In Step 100 of FIG. 6, the laser irradiation portion 80 irradiates the light amount measuring member S with laser light.

In Step 102, the density reading sensor 82 performs processing for reading the density in the light amount measuring member S irradiated with the laser light in Step 100. Specifically, as described previously, the density reading sensor 82 reads the density in the light amount measuring member S irradiated with the laser light by the laser irradiation portion 80, for each of the regions corresponding to the laser light emitting elements respectively. Incidentally, unique element numbers (1 to n) are given to the laser light emitting elements $V_1$ to $V_n$ (see FIG. 5) of the laser irradiation portion 80 in the exemplary embodiment. Unique sensor numbers (I to n) are given to the density sensors $W_1$ to $W_n$ (see FIG. 5) of the density reading sensor 82 in the exemplary embodiment. The element numbers (1 to n) and the sensor numbers (1 to n) correspond to the regions $R_1$ to $R_n$ of the light amount measuring member S respectively.

In Step 104, the CPU 70A selects a sensor number of each density sensor of the density reading sensor 82.

In Step 106, the CPU 70A determines whether the density in a region corresponding to the sensor number selected in Step 104 is lower than intended density or not. When it is determined that the density in the region corresponding to the sensor number is lower than the intended density (in the case of affirmative determination), the CPU 70A moves to Step 108. When it is determined that the density in the region corresponding to the sensor number is not lower than the intended density (in the case of negative determination), the CPU 70A moves to Step 110.

In Step 108, the CPU 70A adjusts the light amount of a laser light emitting element corresponding to the sensor number selected in Step 104. Here, the light amount adjustment processing will be described specifically with reference to FIG. 7.

Figure 7:
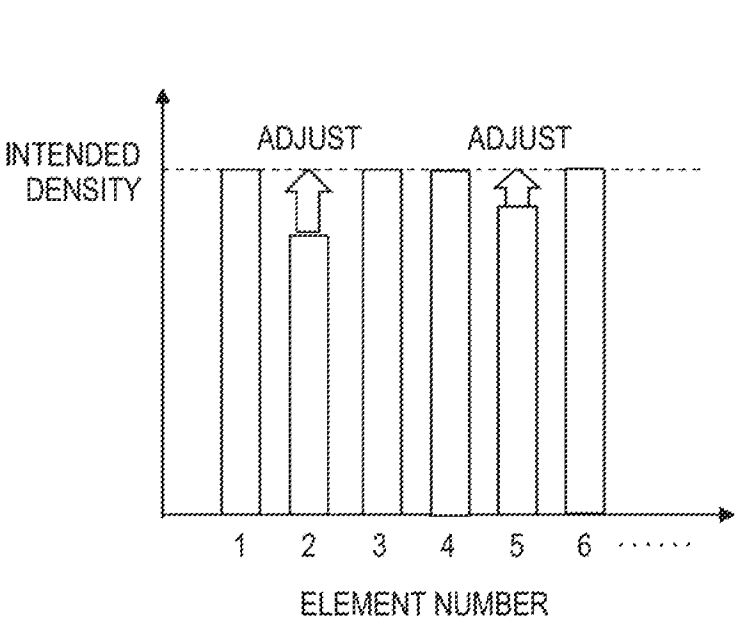
FIG. 7 is a view for explaining light amount adjusting processing according to the exemplary embodiment.

FIG. 7 is a view for explaining the light amount adjustment processing according to the exemplary embodiment.

A data table shown on the right side of FIG. 7 expresses the correspondence between the density in the light amount measuring member S and the laser light amount of the laser irradiation portion 80. The abscissa designates the density in the light amount measuring member S, and the ordinate designates the laser light amount of the laser irradiation portion 80. The data table is created in advance for each type of the light amount measuring member S, and stored in the nonvolatile memory 70D or the like. The graph shown on the left side of FIG. 7 expresses the relationship between each laser light emitting element of the laser irradiation portion 80 and intended density thereof. The element numbers in the abscissa correspond to the laser light emitting elements respectively.

Specifically, for example, using the data table shown on the right side of FIG. 7 the CPU 70A adjusts the light amount of the laser light emitting element so that the density in the region corresponding to the sensor number selected in Step 104 can reach the intended density determined in advance. For example, the light amount is adjusted by adjustment of at least one of a voltage value, a current value or a driving pulse width supplied to the laser light emitting element of the laser irradiation portion 80 so that the density in the region corresponding to the sensor number can reach the intended density as shown in the graph on the left side of FIG. 7.

In Step 110, the CPU 70A determines whether all the sensor numbers corresponding to the density sensors of the density reading sensor 82 have been selected or not. When it is determined that all the sensor numbers have not been selected yet (in the case of negative determination), the CPU 70A returns to Step 104 to repeat the processings. On the other hand, when it is determined that all the sensor numbers have been selected (in the case of affirmative determination), the CPU 70A terminates a series of processings in the light amount adjustment processing program.

In this manner, according to the exemplary embodiment, at least one of thermosensitive paper, photosensitive paper or toner-coated paper is used in place of ink-coated paper, so that the light amount of the laser irradiation portion can be adjusted accurately.

In addition, each of the thermosensitive paper, the photosensitive paper and the toner-coated paper is inexpensive. Further, it is not necessary to use any special external device for the adjustment of the light amount. Thus, the cost can be reduced.

Second Exemplary Embodiment

In the aforementioned first exemplary embodiment, description has been made about the case where the light amount is manually adjusted using predetermined-size cut paper as the light amount measuring member S. On the other hand, in this second exemplary embodiment, description will be made about the case where the light amount is automatically adjusted using continuous paper as the light amount measuring member S.

Figure 8:
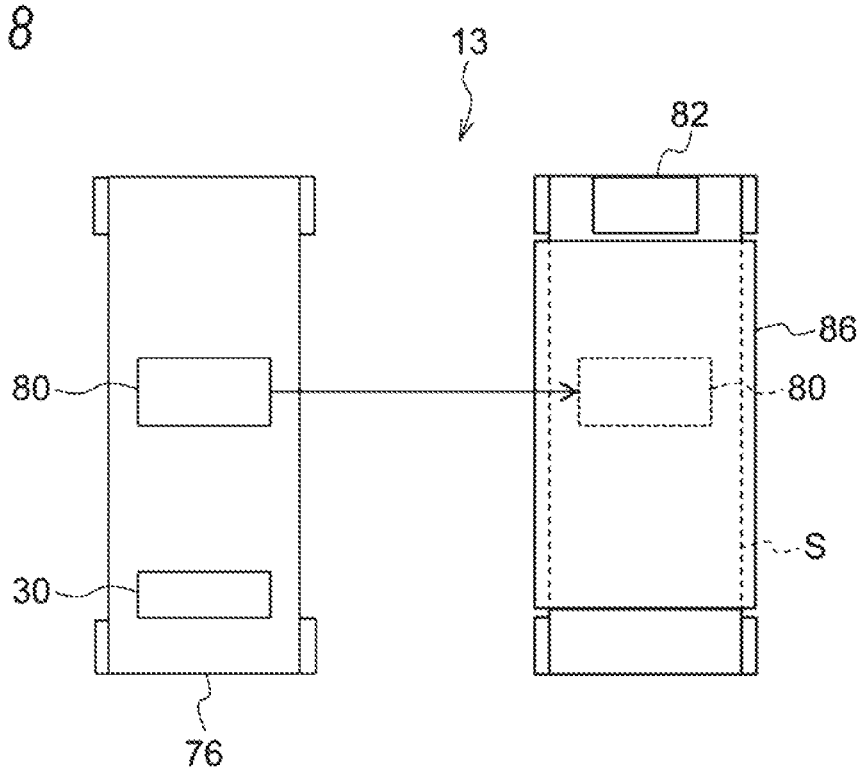
FIG. 8 is a top view schematically showing a main portion configuration of an image forming apparatus according to a second exemplary embodiment.

FIG. 8 is a top view schematically showing a main portion configuration of an image forming apparatus 13 according to the second exemplary embodiment.

Figure 9:
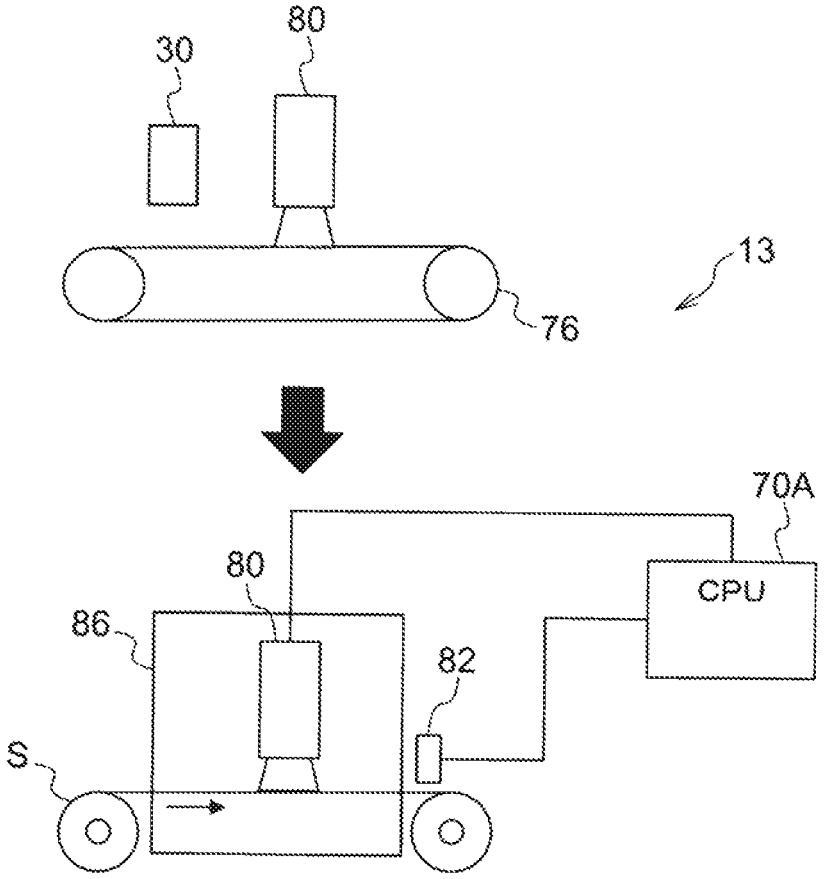
FIG. 9 is a side view schematically showing the main portion configuration of the image forming apparatus according to the second exemplary embodiment.

FIG. 9 is a side view schematically showing the main portion configuration of the image forming apparatus 13 according to the second exemplary embodiment.

Incidentally, the CPU 70A is not shown in FIG. 8 in order to simplify the illustration.

In the image forming apparatus 13 shown in FIG. 8 and FIG. 9, a moving mechanism (not shown) for moving the laser irradiation portion 80 to a light-shielded chamber 86 in order to adjust the light amount of the laser irradiation portion 80. The light amount measuring member S according to the exemplary embodiment is continuous paper. One end of the light amount measuring member S is wound around a feeding roll provided on the downstream side of the light-shielded chamber 86, and the other end of the light amount measuring member S is wound around a winding roll provided on the upstream side of the light-shielded chamber 86. In the same manner as in the aforementioned first exemplary embodiment, at least one of thermosensitive paper, photosensitive paper or toner-coated paper is used as the light amount measuring member S which is continuous paper.

The light-shielded chamber 86 has a light-shielded space which is provided between the feeding roll and the winding roll for the light amount measuring member S so that the laser irradiation portion 80 can be stored inside the light-shielded space. In addition, the density reading sensor 82 is provided near the winding roll. The density reading sensor 82 is provided so that the density reading surface of the density reading sensor 82 faces the light amount measuring member S.

As shown in FIG. 8 and FIG. 9, the laser irradiation portion 80 is provided so that the laser radiating surface of the laser irradiation portion 80 faces the paper feeding portion 76 during normal image formation. In order to adjust the light amount of the laser irradiation portion 80, the laser irradiation portion 80 is controlled to move into the light-shielded chamber 86, and the laser irradiation portion 80 is set so that the laser radiating surface of the laser irradiation portion 80 faces the light amount measuring member S. Incidentally, it is desired that the distance between the light amount measuring member S and the laser radiating surface of the laser irradiation portion 80 is adjusted to be substantially equal to the distance between the recording medium in the paper feeding portion 76 and the laser radiating surface of the laser irradiation portion 80.

Steps after that are the same as those in the aforementioned first exemplary embodiment. The laser irradiation portion 80 irradiates the light amount measuring member S with laser light, and the density reading sensor 82 performs processing for reading the density in the light amount measuring member S which has been irradiated with the laser light. Then, using the reading result of the density in the light amount measuring member S, the CPU 70A adjusts the light amount of the laser irradiation portion 80.

In this manner, according to the exemplary embodiment, the light amount adjustment processing is performed efficiently without necessity to prepare cut paper every time when the light amount of the laser irradiation portion is adjusted.

The image forming apparatus provided with the light irradiation device according to the exemplary embodiment has been described by way of example. The exemplary embodiment may be carried out in a mode as a program for making a computer implement the function of the CPU provided in the image forming apparatus. The exemplary embodiment may be carried out in a mode as a computer-readable memory medium which stores the program.

Further, the configuration of the image forming apparatus described in each of the aforementioned exemplary embodiments is merely an example, and may be changed in accordance with circumstances without departing from the gist of the invention.

In addition, the flow of processing in the program described in each of the aforementioned exemplary embodiments is also an example. Without departing from the gist of the invention, unnecessary steps may be deleted, other steps may be added, or the processing order may be switched.

Although description has been made about the case where a program is executed so that processings according to each of the exemplary embodiments are implemented by a software configuration using a computer, the exemplary embodiment is not limited thereto. For example, the exemplary embodiment may be, for example, implemented by a hardware configuration, or a combination of a hardware configuration and a software configuration.

REFERENCE SIGNS LIST

12,13 image forming apparatus
30 head array
32 ink head
70 control portion
70A CPU
70B ROM

70C RAM
70D nonvolatile memory
70E I/O
70F bus
72 operation display portion
74 paper supply portion
76 paper feeding portion
78 image forming portion
80 laser irradiation portion
82 density reading sensor
84 communication portion

What is claimed is:

1. A light irradiation device comprising:

an irradiation portion that irradiates a substance coated on a sheet-like member with light, the substance having a density varying in accordance with at least one of light or heat; and an adjustment portion that adjusts a light amount of the irradiation portion based on a change of the density of the substance irradiated with the light by the irradiation portion.

2. The light irradiation device according to claim 1, wherein the substance is at least one of: a substance that is discolored due to a chemical reaction by heat; a substance that is discolored due to a chemical reaction by light; or toner.

3. The light irradiation device according to claim 2, wherein the toner is black toner.

4. The light irradiation device according to claim 3, further comprising a measuring portion that measures the density of the substance irradiated with the light.

5. The light irradiation device according to claim 4, wherein:

the irradiation portion comprises a plurality of light sources;

the substance coated on the sheet-like member includes a plurality of regions corresponding to the light sources respectively; and the measuring portion measures the density of each of the regions of the substance irradiated with the light.

6. The light irradiation device according to claim 5, wherein the measuring portion radiates light onto the substance irradiated with the light, and measures the density of the substance for each of the regions, based on intensity of reflected light from the substance.

7. The light irradiation device according to claim 6, wherein the adjustment portion adjusts a light amount of each of the light sources so that the density of the substance measured for each of the regions by the measuring portion reaches intended density determined in advance.

8. The light irradiation device according to claim 2, further comprising a measuring portion that measures the density of the substance irradiated with the light.

9. The light irradiation device according to claim 8, wherein:

the irradiation portion comprises a plurality of light sources;

the substance coated on the sheet-Like member includes a plurality of regions corresponding to the light sources respectively; and the measuring portion measures the density of each of the regions of the substance irradiated with the light.

10. The light irradiation device according to claim 9, wherein the measuring portion radiates light onto the substance irradiated with the light, and measures the density of the substance for each of the regions, based on intensity of reflected light from the substance.

11. The light irradiation device according to claim 10, wherein the adjustment portion adjusts a light amount of each of the light sources so that the density of the substance measured for each of the regions by the measuring portion reaches intended density determined in advance.

12. The light irradiation device according to claim 9, wherein each of the light sources is a light emitting diode or a laser element.

13. The light irradiation device according to claim 2, wherein the substance that is discolored due to a chemical reaction by heat is a solvent containing a leuco dye and a developer reacting with the leuco dye.

14. The light irradiation device according to claim 2, wherein the substance that is discolored due to a chemical reaction by light is photosensitive diazonium salt or silver halide.

15. The light irradiation device according to claim 1, further comprising a measuring portion that measures the density of the substance irradiated with the light.

16. The light irradiation device according to claim 15, wherein:

the irradiation portion comprises a plurality of light sources;

the substance coated on the sheet-like member includes a plurality of regions corresponding to the light sources respectively; and the measuring portion measures the density of each of the regions of the substance irradiated with the light.

17. The light irradiation device according to claim 16, wherein the measuring portion radiates light onto the substance irradiated with the light, and measures the density of the substance for each of the regions, based on intensity of reflected light from the substance.

18. The light irradiation device according to claim 17, wherein the adjustment portion adjusts a light amount of each of the light sources so that the density of the substance measured for each of the regions by the measuring portion reaches intended density determined in advance.

19. The light irradiation device according to claim 16, wherein each of the light sources is a light emitting diode or a laser element.

20. An image forming apparatus comprising:

a forming portion that ejects droplets in accordance with image information so as to form an image corresponding to the image information on a recording medium; and the light irradiation device according to claim 1 that radiates light onto the image formed on the recording medium by the forming portion.

21. A non-transitory computer readable medium storing a program causing a computer to function as the adjustment portion provided in the light irradiation device according to claim 1.

22. A light irradiation method comprising:

irradiating a substance coated on a sheet-like member with light, the substance having a density varying in accordance with at least one of light or heat; and adjusting a light amount of the irradiating based on a change of the density of the substance irradiated with the light.

* * * * *